US006098585A

United States Patent [19]

Brehob et al.

[11] Patent Number: 6,098,585

[45] Date of Patent: Aug. 8, 2000

[54] MULTI-CYLINDER FOUR STROKE DIRECT INJECTION SPARK IGNITION ENGINE

[75] Inventors: Diana Dawn Brehob; Todd Arthur Kappauf, both of Dearborn, Mich.

[73] Assignee: Ford Global Technologies, Inc., Dearborn, Mich.

[21] Appl. No.: 08/909,256

[22] Filed: Aug. 11, 1997

[51] Int. Cl.[7] ..... F02N 17/00

[52] U.S. Cl. ..... 123/179.5; 123/179.4

[58] Field of Search ..... 123/179.5, 179.4, 123/146.5

[56] References Cited

U.S. PATENT DOCUMENTS

| | | | |
|---|---|---|---|
| 3,628,510 | 12/1971 | Moulds | 123/32 |
| 4,009,695 | 3/1977 | Ule | 123/90.13 |
| 4,205,650 | 6/1980 | Szwarcbier | 123/146.5 |
| 4,364,343 | 12/1982 | Malik | 123/179.5 |
| 4,495,924 | 1/1985 | Ueno et al. | 123/478 |
| 4,694,799 | 9/1987 | Yagi et al. | 123/425 |
| 5,074,263 | 12/1991 | Emerson | 123/179.5 |
| 5,687,682 | 11/1997 | Rembold et al. | 123/179.3 |
| 5,713,334 | 2/1998 | Anamoto . | |
| 5,724,950 | 3/1998 | Shino et al. | 123/676 |
| 5,836,288 | 11/1998 | Nakagawa . | |

FOREIGN PATENT DOCUMENTS

| | | |
|---|---|---|
| 31 17 144 A1 | 11/1982 | Germany . |
| 2 104 969 | 8/1982 | United Kingdom . |
| WO93/04278 | 8/1992 | WIPO . |

*Primary Examiner*—Tony M. Argenbright
*Assistant Examiner*—Arnold Castro
*Attorney, Agent, or Firm*—Jerome R. Drouillard

[57] ABSTRACT

An engine is started by identifying a combustion chamber having a predetermined volume of air therein and being in a position past top dead center, injecting fuel into the combustion chamber, thereby providing a combustible mixture, and, igniting the mixture.

22 Claims, 2 Drawing Sheets

MULTI-CYLINDER FOUR STROKE DIRECT INJECTION SPARK IGNITION ENGINE

FIELD OF THE INVENTION

The present invention relates to direct injection engines, and more particularly, systems for starting such engines.

BACKGROUND OF THE INVENTION

Conventional internal combustion engines, including port injection (PI) engines and direct injection (DI) engines, require a starting system to initiate rotation of the crankshaft to start the engine. In PI engines, fuel is delivered to the intake port via a fuel injector, which is attached to a fuel rail, and there, fuel is mixed with intake air to be delivered into the combustion chamber. As the engine rotates with the aid of a starter motor, the air-fuel mixture is inducted into the combustion chamber as the intake valve opens during the intake stroke. An ignition source is then actuated to initiate combustion causing the engine to produce enough power to rotate independently of the starting system. Conventional DI engines also require a similar starting system, although fuel is injected directly into the combustion chamber, where the fuel is mixed with air inducted during the intake stroke.

Typical starting systems for both types of engines consist of a number of discrete components and electrical circuits. The components include: a battery, with associated mounting hardware; an ignition switch; heavy duty battery cables; a magnetic switch (such as an electrical relay or solenoid); a starter motor; a ring gear; and a starter safety switch. In addition, a starter circuit and a control circuit are implemented to circumvent unwanted voltage losses associated with a direct connection of the battery, starter motor and ignition switch. The starter circuit carries the heavy current flow from the battery to the starter motor by way of a magnetic switch or solenoid and supplies power for engine cranking at startup. The control circuit couples the ignition switch to the battery and the magnetic switch, such that the heavy current flow can be regulated.

The inventors of the present invention have found certain disadvantages with these prior art starting systems. For example, detrimental losses can occur in PI and DI engines at startup. These losses include wasted fuel at startup and longer start times. Furthermore, with greater quantities of fuel required at startup, an increase in regulated emissions may occur. That is, fuel preparation (i.e. mixing and vaporization) time is limited by the cranking of the engine.

Also, the battery, heavy duty battery cables, solenoid and starter motor used with current engine starting systems are bulky components. The starter motor requires large electrical currents, typically as high as 200–300 amperes. Consequently, a heavy battery and heavy battery cables are needed, resulting in added weight and space. In addition, the need for a starting circuit adds complexity to the system.

SUMMARY OF THE INVENTION

An object of the present invention is to reduce the mechanical complexity of a starting system in a direct injection engine. This object is achieved and disadvantages of prior art approaches are overcome by providing a novel starting method for such an engine. The engine has an engine block, a crankshaft rotatably disposed within the engine block, at least one piston rotatably connected to the crankshaft and moveable within at least one cylinder in the engine block, and at least one combustion chamber defined by a piston and engine block. The method includes the steps of identifying a combustion chamber having a predetermined volume of air therein and being in a power stroke of the engine; injecting a predetermined amount of fuel into the combustion chamber, thereby providing a combustible mixture; and, igniting the mixture.

An advantage of the present invention is that the size of the relatively large starter motor used in conventional starting systems may be reduced.

Another, more specific, advantage of the present invention is that no starter motor may be required to start the engine.

Another, more specific, advantage of the present invention is that the size and type of the battery and associated conventional starting system components may be reduced.

Yet another advantage of the present invention is that the need for a large ring gear may be obviated.

Still another advantage of the present invention is that engine start time may be reduced.

Yet another advantage of the present invention is that regulated emissions may be reduced due to improved air/fuel preparation at engine startup.

Yet another advantage of the present invention is that the total vehicle weight may be reduced resulting in increased fuel economy.

Another advantage of the present invention is that manufacturing complexity is reduced resulting in increased engine service life.

Still another advantage of the present invention is that eliminating bulky components simplifies underhood packaging, which results in a lower hoodline thereby increasing vehicle aerodynamics and fuel economy.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 1:
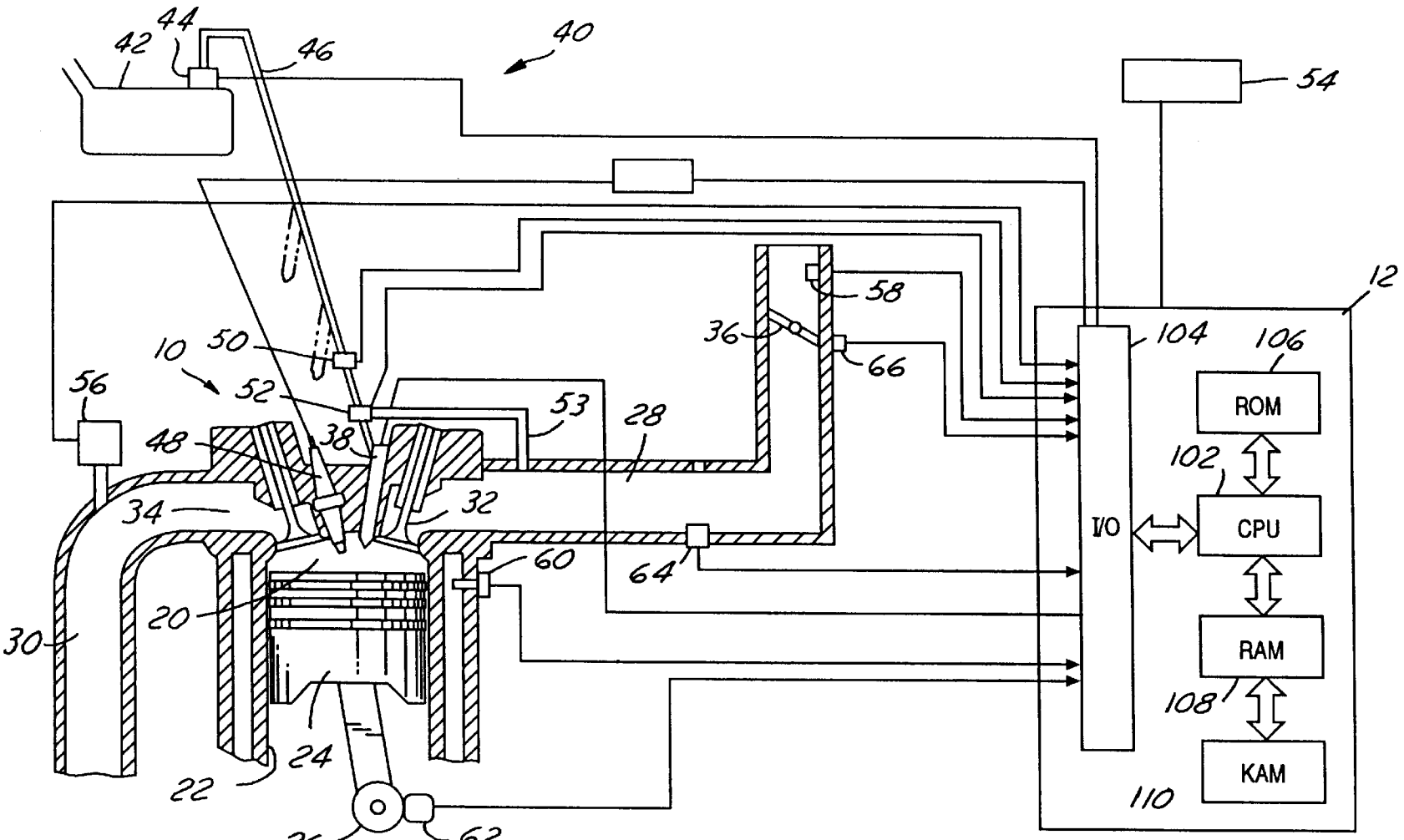
FIG. 1 is a block diagram of a direct injection spark ignition engine incorporating the present invention.

Direct injection spark ignition internal combustion engine 10, comprising a plurality of cylinders, one of which is shown in FIG. 1, is controlled by electronic engine controller 12. Engine 10 includes combustion chamber 20 and cylinder walls 22. Piston 24 is positioned within cylinder walls 22 with conventional piston rings and is connected to crankshaft 26. Combustion chamber 20 communicates with intake manifold 28 and exhaust manifold 30 by intake valve 32 and exhaust valve 34, respectively. Intake manifold 28 communicates with throttle 36 for controlling combustion air entering combustion chamber 20. Fuel injector 38 is mounted to engine 10 such that fuel is directly injected into combustion chamber 20 in proportion to a signal received from controller 12.

Fuel is delivered to fuel injector 38 by, for example, electronic returnless fuel delivery system 40, which comprises fuel tank 42, electric fuel pump 44 and fuel rail 46.

Fuel pump 44 pumps fuel at a pressure directly related to the voltage applied to fuel pump 44 by controller 12. Those skilled in the art will recognize in view of this disclosure, that a high pressure fuel pump (not shown) may be used in fuel delivery system 40. Once fuel has entered combustion chamber 20, it is ignited by means of spark plug 48. Also coupled to fuel rail 46 are fuel temperature sensor 50 and fuel pressure sensor 52. Pressure sensor 52 senses fuel rail pressure relative to manifold absolute pressure (MAP) via sense line 53. Ambient temperature sensor 54 may also be coupled to controller 12.

Controller 12, shown in FIG. 1, is a conventional microcomputer including microprocessor unit 102, input/output ports 104, electronic storage medium for storing executable programs, shown as "Read Only Memory" (ROM) chip 106, in this particular example, "Random Access Memory" (RAM) 108, "Keep Alive Memory" (KAM) 110 and a conventional data bus. Controller 12 receives various signals from sensors coupled to engine 10, in addition to those signals previously discussed, including: ambient air temperature from temperature sensor 54, measurement of mass air flow from mass air flow sensor 58, engine temperature from temperature sensor 60, a profile ignition pick-up signal from Hall effect sensor 62, coupled to crankshaft 26, intake manifold absolute pressure (MAP) from pressure sensor 64 coupled to intake manifold 28, and position of throttle 36 from throttle position sensor 66.

Figure 2:
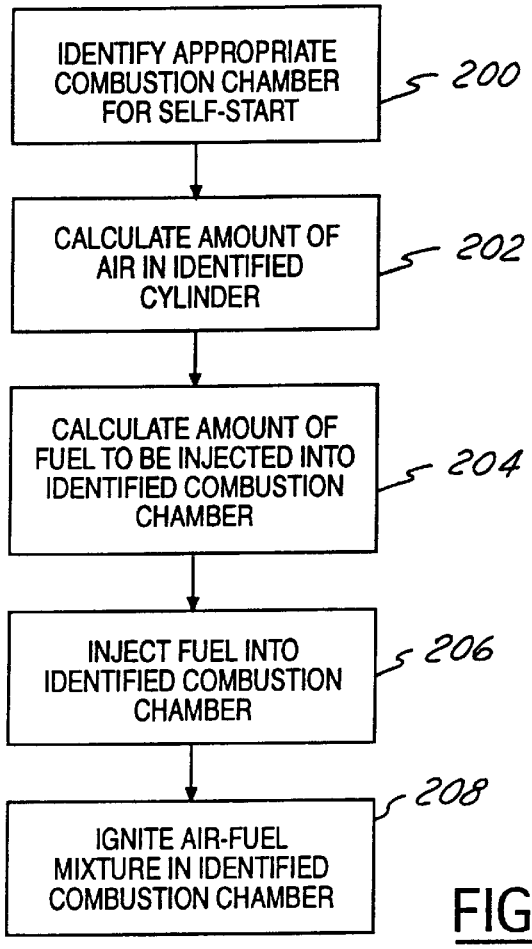
FIG. 2 is a flow chart describing various operations performed by the present invention; and, FIG. 3 is a schematic representation of the rotational position of the engine according to the present invention.
Figure 3:
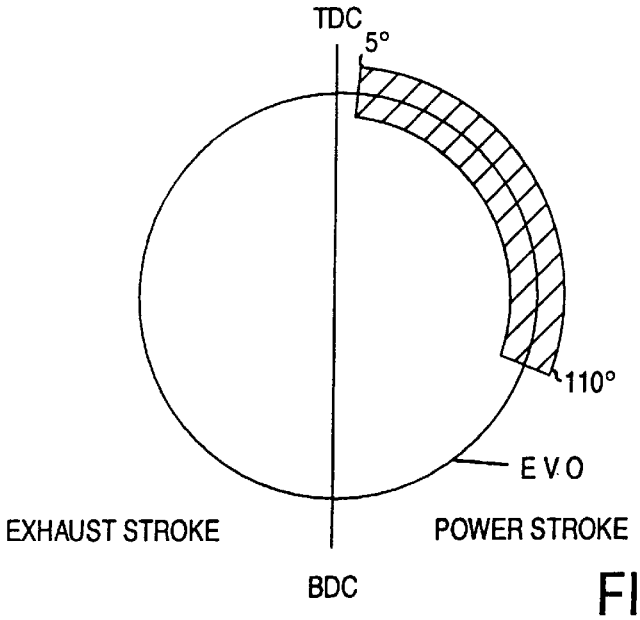

According to the present invention, a method of starting a direct injection engine will now be described specifically with reference to FIGS. 2 and 3. At step 200 controller 12 uses the most recent crank position stored in KAM 110 to identify a combustion chamber 20 being in an appropriate positional tolerance for self-start. That is, controller 12 identifies a piston in a power stroke. During the operation of engine 10, Hall effect sensor 62 updates the position of crankshaft 26 which is then stored in KAM 110 so that when engine 10 is turned off, controller 12 may identify the appropriate combustion chamber for self-start. Alternatively, rather than use information from KAM 100, those skilled in the art will recognize that control algorithms can be implemented to accurately estimate crankshaft position based on inputs from Hall effect sensor 62 and using various dynamic parameters of engine 10, such as, for example, using the aforementioned sensors for predicting final stopping position of engine 10. Alternatively, the position may be measured directly with an encoder. A preferred positional tolerance may be such that crankshaft 26 is at some minimum angle after top-dead-center (TDC). It is undesirable for piston 24 to be too close to TDC, because the minimum amount of air is contained within combustion chamber 20 at TDC. Similarly, it is undesirable for piston 24 to be too close to bottom-dead-center (BDC) where a sufficient amount of rotational momentum cannot be attained. Accordingly, a predetermined range of combustion and movement of crankshaft 26 between TDC and BDC exists, preferably between TDC and a position before opening of the exhaust valve (EVO) (as shown by the shaded area in FIG. 3), which is required to promote combustion and accelerate piston 24 and the crankshaft 26 to the next firing position for autonomous operation of engine 10. This may be, for example, between 5 and 110 degrees after TDC, as shown. Furthermore, it is desirable that piston 24 has crossed over TDC, otherwise engine 10 could rotate in the wrong direction as will become apparent hereafter.

At step 202 controller 12 uses input signals from ambient temperature sensor 54, engine temperature sensor 60, pressure sensor 64, throttle position sensor 66, and Hall effect sensor 62, to determine current pressure, temperature and volume of the space within the identified combustion chamber 20. The volume of space in combustion chamber 20 is a function of the position of crankshaft 26. Using methods known to those skilled in the art, an accurate estimate of the amount of air trapped within combustion chamber 20 could be accomplished using a robust extrapolation algorithm with inputs from aforementioned sensors to calculate a predetermined amount of air within the identified combustion chamber.

At step 204 controller 12 next calculates an appropriate fuel pulsewidth for a desired air-fuel ratio (A/F) to be injected into combustion chamber 20 via fuel injector 38. Once controller 12 calculates the proper fuel pulsewidth, controller 12 sends a signal to fuel delivery system 40, where fuel pump 44 is activated and an appropriate fuel pressure is attained in fuel rail 46 to deliver the required fuel.

At step 206 controller 12 sends a signal to fuel injector 38 to supply the desired amount of fuel to the appropriate combustion chamber 20. Fuel then mixes with the air which is trapped within the identified combustion chamber 20 to provide an appropriate combustible mixture. Once fuel has been injected into combustion chamber 20, a predetermined time delay may be provided for sufficient fuel vaporization to attain complete combustion. It will be apparent to those of ordinary skill in the art that a means of advancing the vaporization process may be used. For example, an electric heater or rapid firing of spark plug 48 could be implemented to increase the temperature of combustion chamber 20. In addition, by using the aforementioned sensors together with a control algorithm, controller 12 may estimate when vaporization of the mixture is complete. Furthermore, controller 12 may estimate an amount of fuel likely to remain in the liquid state after injection into combustion chamber 20 based on a plurality of sensed engine parameters. Controller 12 may then adjust the calculated amount of fuel based on this estimate so that sufficient energy may be produced to rotate engine 10. At step 208, the air-fuel mixture is then ignited in combustion chamber 20 by spark plug 48, and engine 10 assumes autonomous operation.

In an alternative embodiment, if a cylinder is not at an appropriate position to achieve sufficient combustion and rotation, those skilled in the art will realize methods to configure engine 10 into a desirable position. For example, a braking system may be utilized to assure a proper final position of crankshaft 26 or, a means at startup, such as a relatively small rotational displacement motor may be used to advance engine 10 into a desirable startup configuration as previously described. In addition, controller 12 may cause engine 10 to continually operate for a predetermined time period after engine 10 is commanded to shutdown by an operator so that engine 10 may be placed in a desired position for engine start.

While the best mode for carrying out the invention has been described in detail, those skilled in the art in which this invention relates will recognize various alternative designs and embodiments, including those mentioned above, in practicing the invention that has been defined by the following claims.

We claim:

1. A method of starting an engine, the engine having an engine block, a crankshaft rotatably disposed within the engine block, at least one piston rotatably connected to the crankshaft and moveable within at least one cylinder in the engine block, and at least one combustion chamber defined by a piston and engine block, with said method comprising the steps of:

identifying a combustion chamber being in a position past top dead center;

calculating a volume of air contained in the combustion chamber at said position;

calculating an amount of fuel, based on the volume of air in the combustion chamber, to provide a combustible mixture;

admitting the calculated amount of fuel into the combustion chamber; and, igniting said mixture.

2. A method according to claim 1 wherein said identifying step is performed without a prior need to rotate the engine.

3. A method according to claim 1 wherein said identifying step comprises the step of identifying a combustion chamber having a range of air volumes corresponding to a predetermined range of crankshaft angular positions after top dead center and before bottom dead center.

4. A method according to claim 3 wherein the engine further includes an exhaust valve communicating with the combustion chamber and wherein said predetermined range of crankshaft angular positions is between top dead center of the piston and a position before opening of the exhaust valve.

5. A method according to claim 4 wherein said predetermined range of crankshaft angular positions is between about 5° and 110° after top dead center.

6. A method according to claim 1 wherein said step of identifying said combustion chamber being in a position past top dead center comprises the step of predicting said combustion chamber when the engine is turned off.

7. A method according to claim 1 further comprising the step of stopping the engine at a predetermined crankshaft angular position.

8. A method according to claim 1 wherein said admitting step comprises the steps of:

sensing an ambient temperature; and, calculating an amount of fuel sufficient to promote combustion of said mixture based on said sensed ambient temperature.

9. A method according to claim 1 further comprising the step of heating the air in said identified combustion chamber prior to injecting the fuel.

10. A method according to claim 1, wherein said engine has a demand input by an operator pressing a pedal, the method comprising said calculated fuel amount being determined without regard to the demand from said pedal.

11. A method according to claim 1 wherein said igniting step comprises the step of igniting said mixture after a predetermined time period to allow for increased mixing of air and fuel within said combution chamber.

12. A method of starting an engine, the engine having an engine block, a crankshaft rotatably disposed within the engine block, at least one piston rotatably connected to the crankshaft and moveable within at least one cylinder in the engine block, and at least one combustion chamber defined by a piston and engine block, with said method comprising the steps of:

identifying a combustion chamber being in a position past top dead center;

estimating an amount of fuel likely to remain in liquid form when injected into said combustion chamber; and, calculating an amount of fuel sufficient to promote combustion of said mixture based on said estimate;

admitting the calculated amount of fuel into the combustion chamber; and igniting said mixture.,

13. A multi-cylinder, four stroke direct injection spark ignition engine comprising a cylinder block;

a crankshaft rotatably disposed within the cylinder block;

a plurality of pistons reciprocally housed in a plurality of cylinder bores formed in said cylinder block;

a cylinder head mounted to the cylinder block so as to close the outer end of said cylinder bores;

a plurality of combustion chambers defined by said cylinder head, said pistons and said cylinder bores;

a plurality of electronically actuated fuel injectors disposed to inject fuel directly into said combustion chambers;

a plurality of spark plugs for igniting an air/fuel mixture in said combustion chambers; and, a controller for starting the engine, with said controller comprising:

a combustion chamber identifier for identifying a combustion chamber being in a position past top dead center;

calculating a volume of air contained in the combustion chamber at said position;

calculating an amount of fuel, based on the volume of air in the combustion chamber, to provide a combustible mixture;

a fuel injector actuator for actuating said injector to inject the calculated amount of fuel in said combustion chamber; and, a spark plug actuator for actuating said spark plug to produce a spark in said identified combustion chamber.

14. An engine according to claim 13 wherein said controller identifies a piston in a position past top dead center, with the position of said piston corresponding to a predetermined range of crankshaft angular positions.

15. An engine according to claim 14 wherein said predetermined range of crankshaft angular positions is between about 5° and 110° after top dead center.

16. An engine according to claim 13 further comprising a heating means to heat the air in said identified combustion chamber.

17. An article of manufacture comprising:

a computer storage medium having a computer program encoded therein for causing a computer to start a multi-cylinder, four-stroke direct injection spark ignition engine, the engine having an engine block, crankshaft rotatably disposed within the engine block, at least one piston rotatably connected to the crankshaft and moveable within the engine block, and at least one combustion chamber defined by a piston and engine block, the engine further including a fuel injector disposed to inject fuel directly into the combustion chamber and a spark plug disposed to ignite a fuel and air mixture in the combustion chamber, with said computer storage medium comprising:

a computer readable program code means for causing said computer to identify a combustion chamber having a volume of air therein and being in a position past top dead center;

a computer readable program code means for causing said computer to calculate a volume of air contained in the combustion chamber and calculate an amount of fuel, based on the volume of air in the combustion chamber, to provide a combustible mixture and actuate the fuel injector to inject the calculated amount of fuel into the combustion chamber; and, a computer readable program code means for causing said computer to actuate the spark plug to ignite said mixture.

18. An article of manufacture according to claim 17 further comprising a computer readable program code means for causing said computer to identify a combustion chamber having a range of air volumes corresponding to a predetermined range of crankshaft angular positions after top dead center and before bottom dead center.

19. An article of manufacture according to claim 18 wherein said predetermined range of crankshaft angular positions is between about 5° and 110° after top dead center.

20. An article of manufacture according to claim 17 wherein said computer storage medium comprises an electronically programmable chip.

21. An article of manufacture according to claim 17, further comprising said computer readable program code means determining an engine demand determined by a pedal position, the code means calculating said fuel amount without regard to the demand from said pedal.

22. An article of manufacture comprising:

a computer storage medium having a computer program encoded therein for causing a computer to start a multi-cylinder, four-stroke direct injection spark ignition engine, the engine having an engine block, crankshaft rotatably disposed within the engine block, at least one piston rotatably connected to the crankshaft and moveable within the engine block, and at least one combustion chamber defined by a piston and engine block, the engine further including a fuel injector disposed to inject fuel directly into the combustion chamber and a spark plug disposed to ignite a fuel and air mixture in the combustion chamber, with said computer storage medium comprising:

a computer readable program code means for causing said computer to identify a combustion chamber having a volume of air therein and being in a position past top dead center;

a computer readable program code means for causing said computer to estimate an amount of fuel likely to remain in liquid form when injected into said combustion chamber;

a computer readable program code means for causing said computer to calculate an amount of fuel sufficient to promote combustion of said mixture based on said estimate;

a computer readable program code means for causing said computer to actuate the fuel injector to inject said calculated amount of fuel into the combustion chamber, thereby providing a combustible mixture; and a computer readable program code means for causing said computer to actuate the spark plug to ignite said mixture.

* * * * *